US007538494B2

(12) United States Patent
Kim et al.

(10) Patent No.: US 7,538,494 B2
(45) Date of Patent: May 26, 2009

(54) PLASMA DISPLAY PANEL

(75) Inventors: Hyun Kim, Suwon-si (KR); Kyoung-Doo Kang, Suwon-si (KR); Se-Jong Kim, Suwon-si (KR); Yun-Hee Kim, Suwon-si (KR); Hyun Soh, Suwon-si (KR); Jin-Won Han, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 462 days.

(21) Appl. No.: 11/424,265

(22) Filed: Jun. 15, 2006

(65) Prior Publication Data

US 2006/0284547 A1 Dec. 21, 2006

(30) Foreign Application Priority Data

Jun. 18, 2005 (KR) ..... 10-2005-0052741

(51) Int. Cl.
*H01J 17/49* (2006.01)

(52) U.S. Cl. ..... 313/587; 313/585

(58) Field of Classification Search ..... None
See application file for complete search history.

(56) References Cited

U.S. PATENT DOCUMENTS

| | | | | |
|---|---|---|---|---|
| 6,995,512 | B2 * | 2/2006 | Otani | 313/587 |
| 7,023,135 | B2 * | 4/2006 | Lee | 313/582 |
| 7,034,458 | B2 * | 4/2006 | Asida et al. | 313/582 |
| RE39,488 | E * | 2/2007 | Park et al. | 313/586 |
| 2005/0017637 | A1 * | 1/2005 | Kang et al. | 313/582 |
| 2005/0088094 | A1 * | 4/2005 | Kim et al. | 313/583 |
| 2005/0242730 | A1 * | 11/2005 | Mizuta | 313/586 |
| 2005/0253516 | A1 * | 11/2005 | Kwon et al. | 313/582 |

FOREIGN PATENT DOCUMENTS

| | | |
|---|---|---|
| JP | 2000285811 | 10/2000 |
| JP | 2003217455 | 7/2003 |
| JP | 2004006307 | 1/2004 |
| JP | 2004039521 | 2/2004 |
| JP | 2005-093155 | 4/2005 |

* cited by examiner

*Primary Examiner*—Ashok Patel
(74) *Attorney, Agent, or Firm*—H.C. Park & Associates, PLC

(57) ABSTRACT

A plasma display panel including common and scanning electrodes arranged on a first substrate. A first dielectric layer covers the common electrodes and the scanning electrodes, and it includes groove shaped field concentration units. The width of end parts of a field concentration unit is greater than the width of the central part of the field concentration unit.

20 Claims, 12 Drawing Sheets

PLASMA DISPLAY PANEL

CROSS-REFERENCE TO RELATED APPLICATION

This application claims priority to and the benefit of Korean Patent Application No. 10-2005-0052741, filed on Jun. 18, 2005, which is hereby incorporated by reference for all purposes as if fully set forth herein.

BACKGROUND OF THE INVENTION

1. Field of the Invention

The present invention relates to a plasma display panel, and more particularly, to a plasma display panel that forms a substantially uniform field around an electrode having a protruded structure.

2. Discussion of the Background

Plasma display panels are becoming increasingly popular large flat display devices. Generally, a plasma display panel includes two substrates with a gas-filled discharge space therebetween, and a plurality of electrodes is formed on the substrates. The plasma display panel displays desired images using visible light emitted by exciting a phosphor material with ultraviolet rays generated from a gas discharge in the discharge space when applying a voltage to the electrodes.

A conventional plasma display panel includes a first panel and a second panel. The first panel typically includes a first substrate, common (X) electrodes, scanning (Y) electrodes, a first dielectric layer, and a protection film. The X and Y electrodes each include a transparent electrode and a bus electrode. The second panel typically includes a second substrate, address (A) electrodes, a second dielectric layer, barrier ribs, and a phosphor layer.

The first substrate and the second substrate are arranged parallel to each other, and they separated from each other such that they face each other. The barrier ribs partition the discharge space between the panels into unit discharge cells in which discharge occurs. The X and Y electrodes cross with A electrodes in the discharge cells. The dielectric layer and the electrodes included in the discharge cells form a panel capacitor.

When the distance between the X and Y electrodes is reduced, a driving voltage applied to the electrodes may be reduced proportionally to the distance reduction. However, in this case, the panel's light emission efficiency may decrease since a wide discharge space may not be utilized, making it more difficult to display bright images. Also, when reducing the distance between the X and Y electrodes, the panel capacitance increases proportionally to the distance reduction.

On the other hand, when the distance between the X and Y electrodes, which generate a sustain discharge, is increased, a wide discharge space may be utilized, thereby increasing light emission efficiency. However, a driving voltage may increase in proportion to the increased distance, resulting in increased power consumption.

SUMMARY OF THE INVENTION

The present invention provides a plasma display panel that forms a substantially uniform field around electrodes having a protruded structure.

Additional features of the invention will be set forth in the description which follows, and in part will be apparent from the description, or may be learned by practice of the invention.

The present invention discloses a plasma display panel including a first substrate and a second substrate that face each other. Barrier ribs define a plurality of discharge cells in a space between the first substrate and the second substrate, and X electrodes and Y electrodes are arranged on the first substrate with a protruded structure in the discharge cells. A first dielectric layer covers the X electrodes and the Y electrodes, and it has groove shaped field concentration units. A electrodes are arranged on the second substrate and extend perpendicular to the X electrodes, and a second dielectric layer covers the A electrodes. A phosphor layer is arranged in the discharge cells, and a discharge gas is included in the discharge cells. End parts of the field concentration units are wider than the central part of the field concentration units.

The present invention also discloses a plasma display panel including a first substrate and a second substrate that face each other. Barrier ribs define a plurality of discharge cells in a space between the first substrate and the second substrate, and first electrodes and second electrodes are arranged on the first substrate. A dielectric layer covers the first electrodes and the second electrodes, and it includes groove shaped field concentration units arranged between the first electrodes and the second electrodes. Ends of the field concentration units are wider than the central part of the field concentration units.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
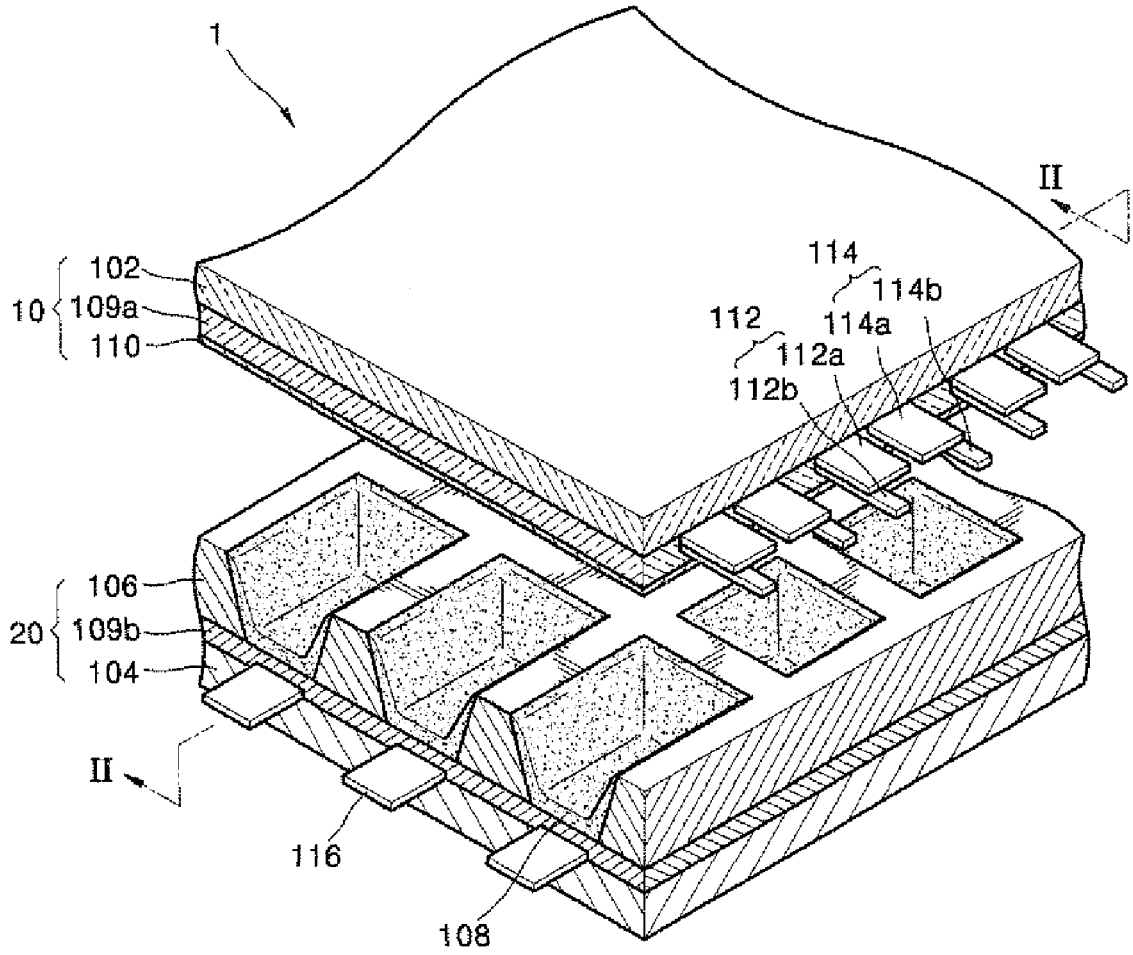
FIG. 1 is an exploded perspective view of a plasma display panel including field concentration units according to an exemplary embodiment of the present invention.

The present invention will now be described more fully with reference to the accompanying drawings in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or s intervening elements may also be present. In contrast, when an element is referred to as being "directly on" another element, there are no intervening elements present.

Figure 2:
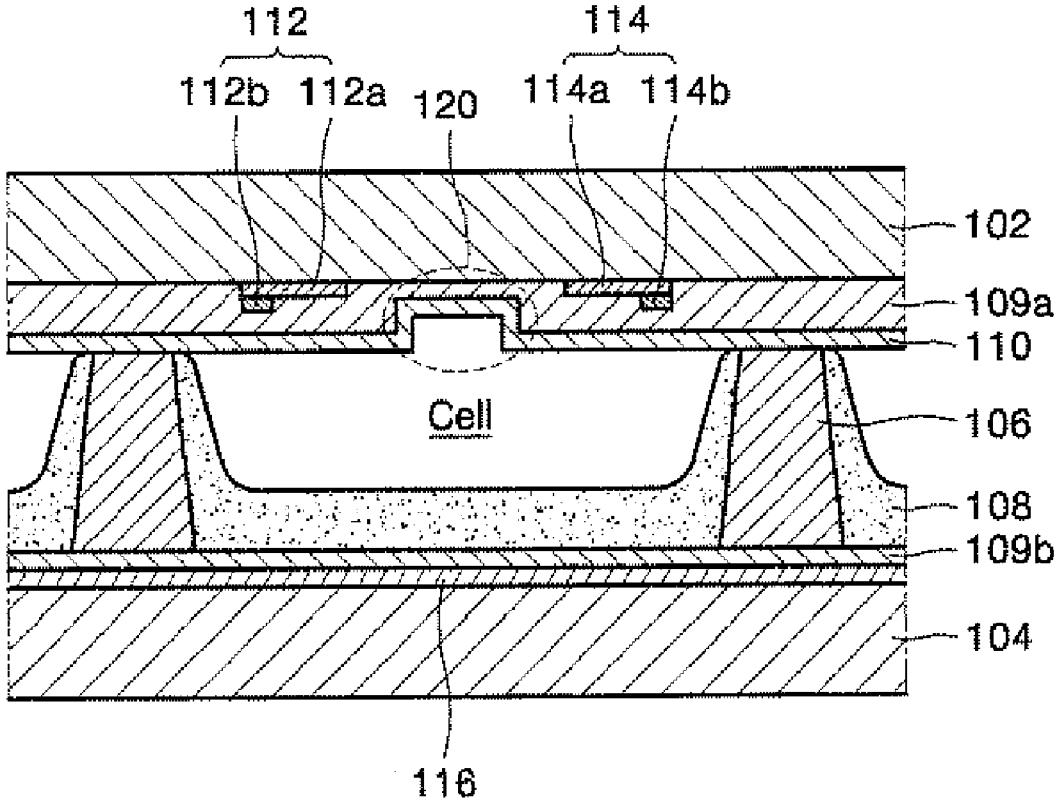
FIG. 2 is a cross-sectional view taken along line II-II of FIG. 1.

FIG. 1 is an exploded perspective view of a plasma display panel 1 including a field concentration unit according to an exemplary embodiment of the present invention, and FIG. 2 is a cross-sectional view taken along line II-II of FIG. 1.

Referring to FIG. 1 and FIG. 2, the plasma display panel 1 includes a first panel 10 and a second panel 20. The first panel 10 includes the first substrate 102, X electrodes 112, Y electrodes 114, a first dielectric layer 109*a*, and a protection film 110. Each X electrode 112 includes a transparent electrode 112*a* and a bus electrode 112*b*, and each Y electrode 114 includes a transparent electrode 114*a* and a bus electrode 114*b*. The second panel 20 includes a second substrate 104, A electrodes 116, a second dielectric layer 109*b*, barrier ribs 106, and a phosphor layer 108.

The first substrate 102 and the second substrate 104 are separated by a predetermined distance, and they are arranged to face each other. The first substrate 102 may be substantially parallel to the second substrate 104. The barrier ribs 106 define a plurality of discharge cells in the space between the first substrate 102 and the second substrate 104.

The A electrodes 116 are arranged on the second substrate 104 in a direction substantially perpendicular to the X electrodes 112 and the Y electrodes 114. The N electrodes 112 and the Y electrodes 114 may cross with the A electrodes 116 in each discharge cell. The phosphor layer 108 is arranged on the barrier ribs 106 and the second dielectric layer 109*b*, and a discharge gas is filled in the discharge cells.

The first dielectric layer 109*a* covers the X electrodes 112 and the Y electrodes 114. Groove-shaped field concentration units 120 are formed on a surface of the first dielectric layer 109*a* facing the discharge cells. A protection film 110, which may be formed of magnesium oxide (MgO), is arranged on a surface of the first dielectric layer 109*a* facing the discharge cells to protect the first dielectric layer 109*a*. The second dielectric layer 109*b* covers the A electrodes 116.

The X electrodes 112 and the Y electrodes 114 are arranged on the first substrate 102, and they extend substantially parallel to each other. A portion of each of the X electrode 112 and the Y electrode 114 corresponding to a discharge cell has a protruded structure. A cross-section of the field concentration unit 120 cut parallel to the first substrate 102 is wider at end portions than at a central portion.

The cross-section of the field concentration unit 120 cut perpendicular to the first substrate 102 and parallel to the A electrode 116 may be substantially rectangular.

Also, as shown in FIG. 5, FIG. 6A, FIG. 6B, and FIG. 6C, the cross-section of the field concentration unit 120 cut perpendicular to the first substrate 102 and parallel to the A electrode 116 may be substantially trapezoidal.

The barrier ribs 106 define unit discharge cells, in which a discharge takes place, in the space between the first substrate 102 and the second substrate 104. A discharge gas at a pressure lower than atmospheric pressure (approximately less than 0.5 atm) is filled in the discharge cells. Collision of discharge gas particles with charges due to an electric field formed by a driving voltage applied to the electrodes located in each discharge cell generate plasma discharge, which generates vacuum ultraviolet rays.

The discharge gas may be a gas mixture containing one or more of Ne gas, He gas, and Ar gas mixed with Xe gas.

The barrier ribs 106 define the discharge cells to be basic units of an image, and they prevent cross-talk between the discharge cells. According to an exemplary embodiment of the present invention, a horizontal cross-section of the discharge cells, i.e., a cross-section parallel to the first substrate 102 and the second substrate 104, may be polygonal, for example, rectangular, hexagonal, or octagonal; circular; or oval, and may vary according to the arrangement of the barrier ribs 106.

Electrons in the phosphor layer 108 are excited by absorbing vacuum ultraviolet rays generated by discharge, and photo luminescence occurs. That is, the excited electrons of the phosphor layer 108 generate visible light when they return to a stable state. The phosphor layer 108 may include red, green, blue phosphor layers such that the plasma display panel may display a color image. Three adjacent discharge cells having red, green, and blue phosphor layers, respectively, may constitute a unit pixel.

The red phosphor may be $(Y,Gd)BO_3:Eu^{3+}$, etc., the green phosphor may he $Zn_2Si0_4:Mn^{2+}$, etc., and the blue phosphor may be $BaMgAl_{10}O_{17}:Eu^{2+}$, etc. In the drawings, the phosphor layer 108 is shown arranged on the second dielectric layer 109*b* and the barrier ribs 106 of the discharge cell. However, the phosphor layer may have various arrangements.

The first dielectric layer 109*a* insulates the X electrodes 112 and the Y electrodes 114, and it is formed of a material having high electrical resistance and high light transmittance. Some charges generated by discharge form wall charges on the protection film 110 near the first dielectric layer 109*a* by being attracted to an electrical attractive force caused by the polarity of a voltage applied to the X and Y electrodes 112 and 114.

The second dielectric layer 109*b* insulates the A electrodes 116, and it is formed of a material having high electrical resistance.

The protection film 110 protects the first dielectric layer 109*a*, and it facilitates discharge by increasing the emission of secondary electrons. The protection film 110 may be formed of a material such as magnesium oxide (MgO).

The transparent electrodes 112*a* and 114*a* are formed of a transparent material, such as indium tin oxide (ITO), so that they may transmit visible light emitted from the discharge cells. The transparent electrodes 112*a* and 114*a* typically have high electrical resistance. Hence, the electrical conductivity of the transparent electrodes 112*a* and 114*a* may be increased by including the bus electrodes 112*b* and 114*b*, which may be formed of a metal having high electrical conductivity.

The field concentration unit 120 may be formed by, for example, etching the first dielectric layer 109*a*. The field concentration unit 120 reduces a discharge path between the X is electrodes 112 and the Y electrodes 114. The field concentration effects of the central portion of the groove shaped space of the field concentration unit 120 and the reduced discharge path increase the density of electrons (negative charges) and ions (positive charges) in the field concentration unit 120, thereby facilitating discharge between the X electrodes 112 and the Y electrodes 114. Also, when including the field concentration unit 120, utilization of the discharge space may be increased by increasing the distance between the X electrodes 112 and the Y electrodes 114, thus increasing light emission efficiency. Also, the transmittance of visible light emitted from the discharge cells through the first panel 10 may be increased ill proportion to the amount of the first dielectric layer 109*a* that is etched.

Figure 5:
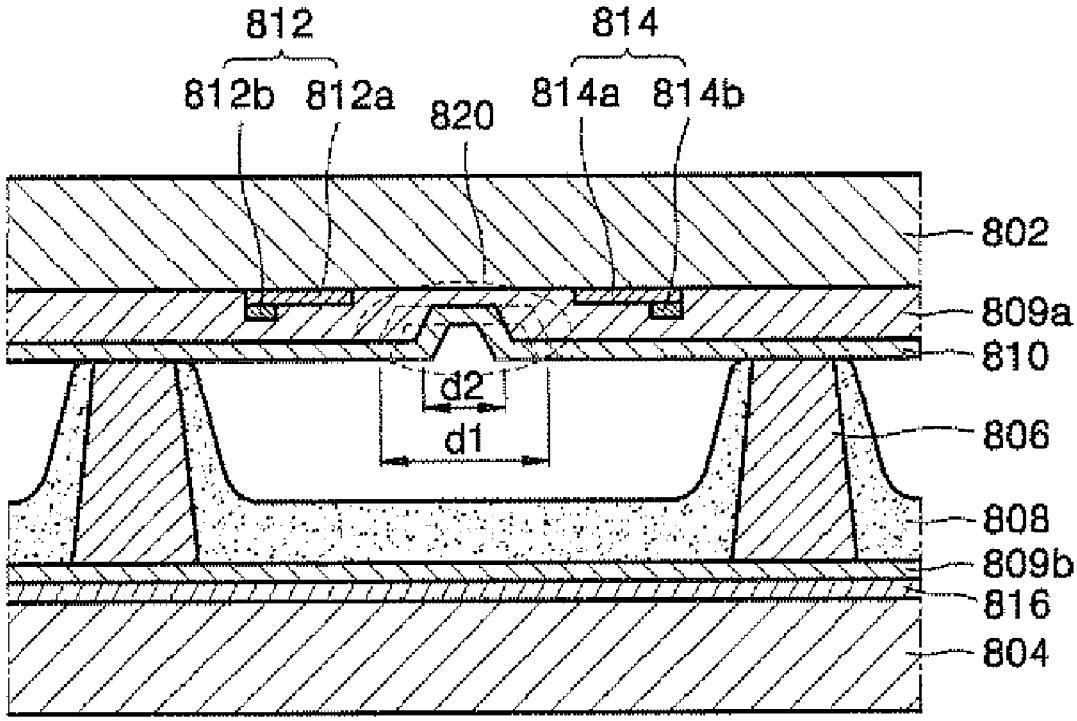
FIG. 5 is a cross-sectional view of a field concentration unit of a plasma display panel according to an exemplary embodiment of the present invention.

In FIG. 2, the cross-section of the field concentration unit 120, i.e., a cross-section perpendicular to the first substrate and parallel to the A electrodes 116, is substantially rectangular. As shown in FIG. 5, the cross-section of the field concentration unit 120 may be substantially trapezoidal. Furthermore, the cross-section of the field concentration unit 120 may s have various shapes.

Figure 3A:
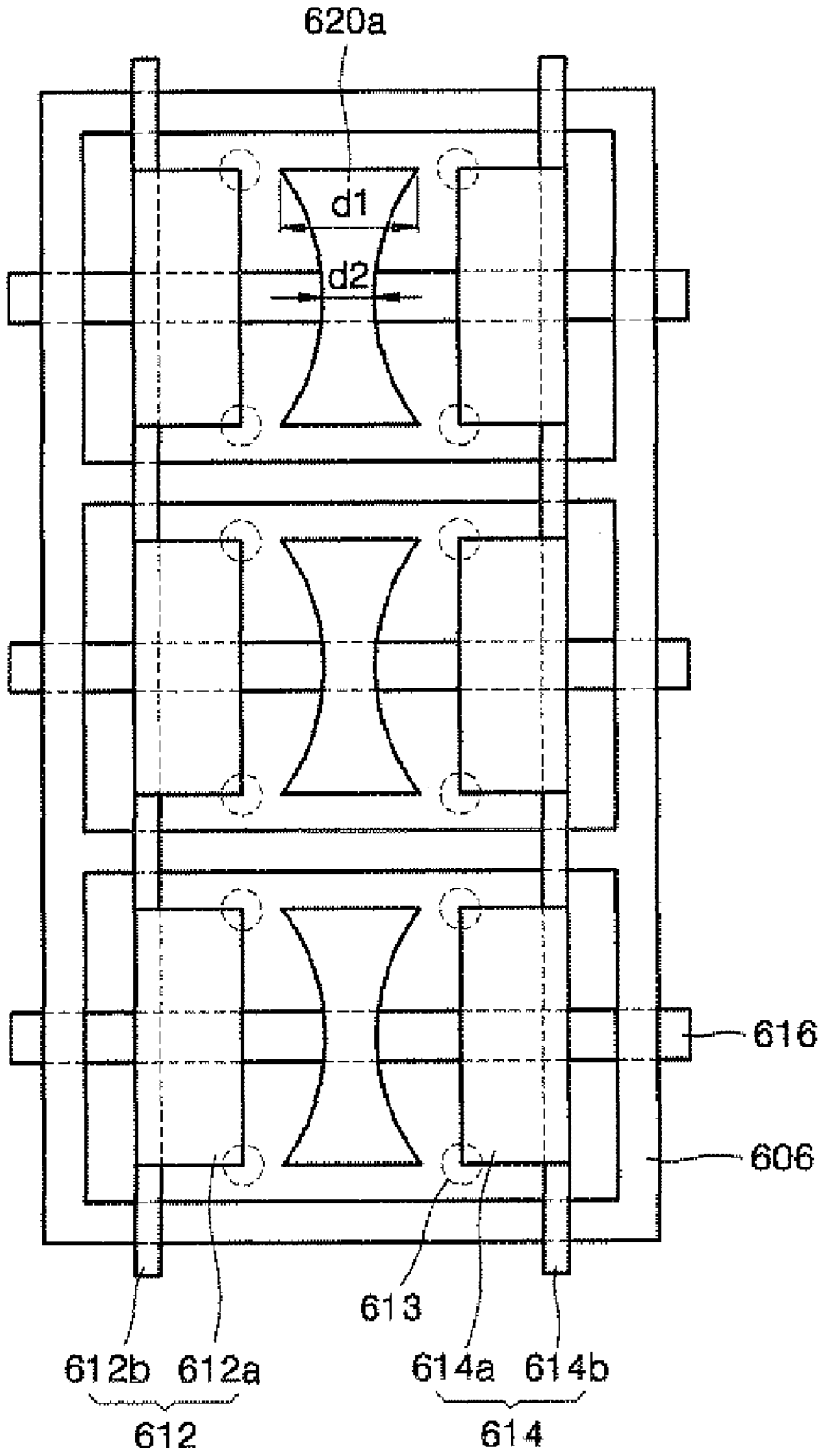
FIG. 3A, FIG. 3B, and FIG. 3C are schematic drawings of discharge cells including field concentration units of plasma display panels according to exemplary embodiments of the present invention.
Figure 3B:
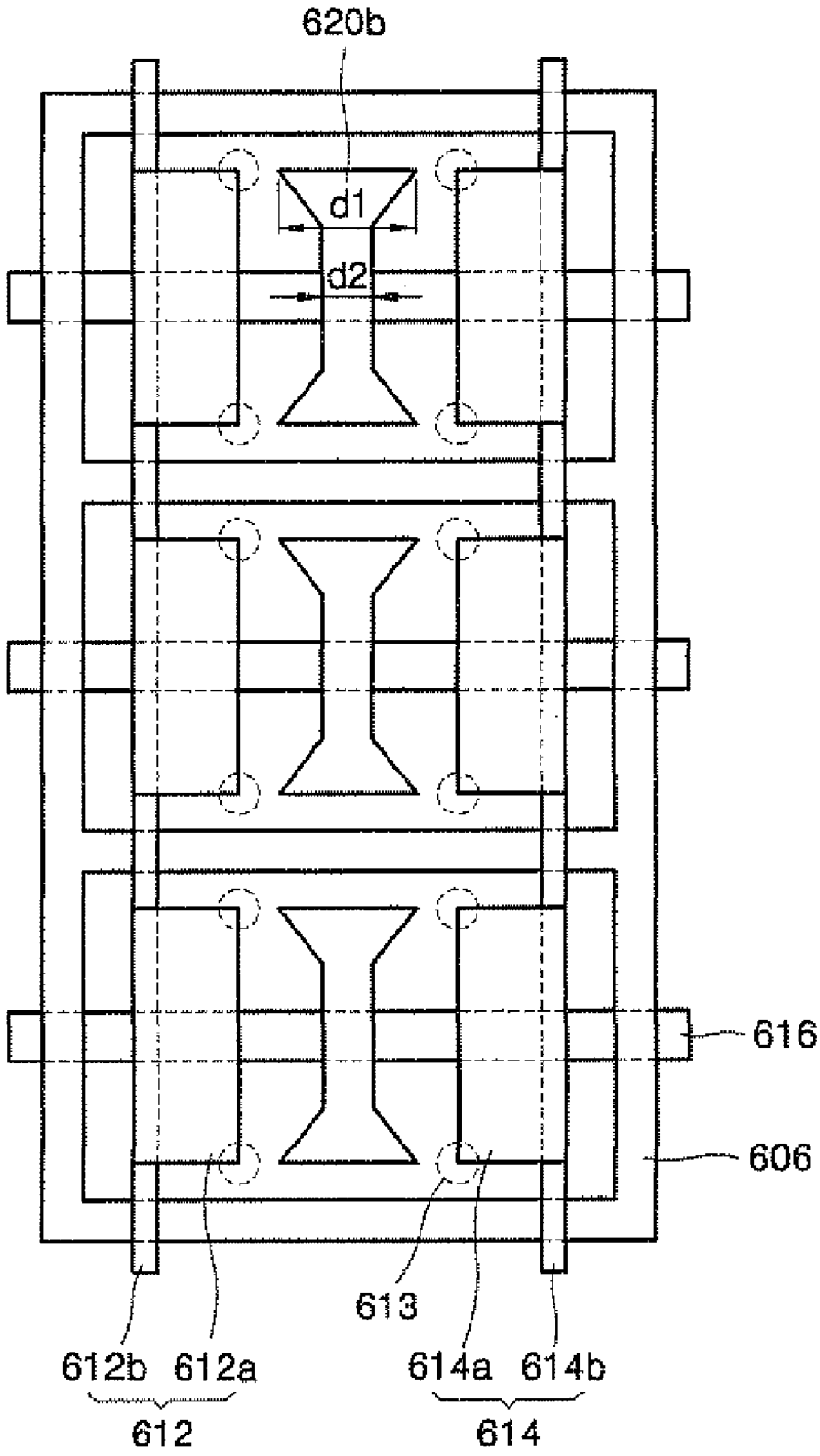
Figure 3C:
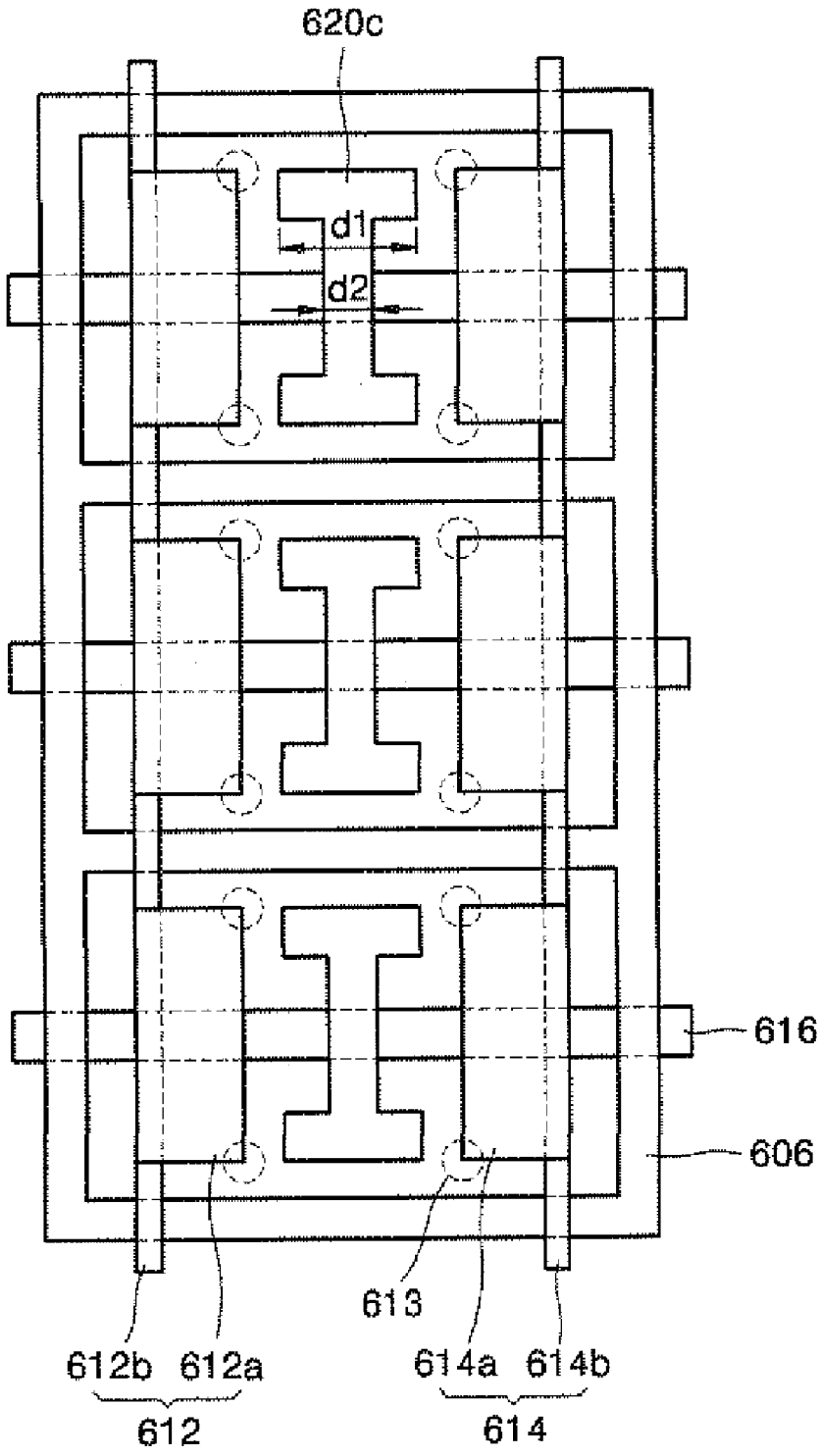

FIG. 3A, FIG. 3B, and FIG. 3C are schematic drawings of discharge cells including field concentration units of plasma display panels according to exemplary embodiments of the present invention.

Referring to FIG. 3A, FIG. 3B, and FIG. 3C, barrier ribs 606 define a plurality of discharge cells in the space between the first substrate 102 and the second substrate 104 (see FIG. 1). An A electrode 616 is arranged on the second substrate 104 substantially perpendicularly with an X electrode 612 and a Y electrode 614. The X electrode 612 and the Y electrode 614 include protruded portions corresponding to the discharge cells.

The X electrode 612 and the Y electrode 614 include bus electrodes 612*b* and 614*b* and transparent electrodes 612*a* and 614*a*, respectively. The bus electrodes 612*b* and 614*b* may be formed as a single body that extends across the plasma display panel. The transparent electrodes 612*a* and 614*a* may include segments in a divided structure corresponding to each of the discharge cells.

The transparent electrodes 612*a* and 614*a* protrude toward the central portion of the discharge cells from portions of the bus electrodes 612*b* and 614*b* corresponding to the discharge cells. The transparent electrodes 612*a* and 614*a* include segments in a divided structure, which are separated by portions of the bus electrodes 612*a* and 614*a* corresponding to the barrier ribs 606. However, like the bus electrodes 612*b* and 614*b*, the transparent electrodes 612*a* and 614*a* may be formed as a single body that extends across the panel, instead of in a divided structure.

The transparent electrodes 612*a* and 614*a* having a divided structure may appear as rectangular protruded structures when viewed from the first substrate. However, the rectangular protrusions have corner parts 613, as indicated by the dotted circles in FIG. 3A, FIG. 3B, and FIG. 3C. In this case, an electric field may be concentrated near the corner parts 613 of the transparent electrodes 612*a* and 614*a* in the discharge cells, thereby forming a non-uniform electric field in the discharge space between the X electrode 612 and the Y electrode 614.

Therefore, in cross sections of the field concentration units 620*a*, 620*b*, and 620*c* cut parallel to the first substrate 102, the widths d1 of end portions of the field concentration units 620*a*, 620*b*, and 620*c* are greater than the widths d2 of the central part of the field concentration units 620*a*, 620*b*, and 620*c*. That is, the field concentration units 620*a*, 620*b*, and 620*c* may be designed to offset the field concentration caused by the corner parts 613 of the transparent electrodes 612*a* and 614*a*.

A field concentration is generated in a groove shaped space of the field concentration units 620*a*, 620*b*, and 620*c*. In this case, the narrower portions of the field concentration units 620*a*, 620*b* or 620*c* produce a stronger field concentration. That is, as the field concentration units 620*a*, 620*b*, and 620*c* widen, the field concentration decreases in the discharge spaces according to the increased widths. On the other hand, as the field concentration units 620*a*, 620*b*, and 620*c* narrow, the field concentration increases in the discharge spaces according to the reduced widths.

Embodiments of the present invention utilize the field concentration characteristic of the electrode corner parts 613 and the field concentration units 620*a*, 620*b*, and 620*c*. That is, the widths d1 of the ends of the field concentration units 620*a*, 620*b*, and 620*c*, which correspond to the corner parts 613 of the transparent electrodes 612*a* and 614*a*, are greater than the widths d2 of the central parts of the field concentration units 620*a*, 620*b*, and 620*c*, which correspond to the central parts of the transparent electrodes 612*a* and 614*a*.

Accordingly, a substantially uniform field may be formed over the entire portion of the discharge space corresponding to the field concentration units 620*a*, 620*b*, and 620*c*. That is, considering that the central parts of the field concentration units 620*a*, 620*b*, and 620*c* do not have corner parts, to make the field strength near the central parts of the field concentration units 620*a*, 620*b*, and 620*c* substantially equivalent to the field strength near the ends of the field concentration units 620*a*, 620*b*, and 620*c*, the widths at the central parts of the field concentration units 620*a*, 620*b*, and 620*c* are reduced.

To this end, a plurality of the field concentration units 620*a*, 620*b*, or 620*c* may be formed in a portion of the first dielectric layer 110 corresponding to each discharge cell. The field concentration units 620*a*, 620*b*, and 620*c* may be separated by a portion of the first dielectric layer 110 corresponding to the barrier ribs.

As shown in FIG. 3A, FIG. 3B, and FIG. 3C, the field concentration units 620*a*, 620*b*, and 620*c* may have various plane shapes. In FIG. 3A, the width of the cross-section of the field concentration unit 620*a* decreases from its ends to its center in parabolic form. That is, the width of the cross-section of the field concentration unit 620*a* gradually decreases from d1 to d2 to substantially form a parabola.

In FIG. 3B, the width of the cross-section of the field concentration unit 620*b* gradually decreases at a fixed rate from d1 at the ends to d2 at a certain point, and the width d2 is constant in the central part. That is, the width of the cross-section decreases from d1 to d2 at the end parts, and the width d2 of the central part is constant.

In FIG. 3C, the width d1 of end parts of the cross-section of the field concentration unit 620*c* is constant, and the width d2 of the central part is constant. In all cases shown in FIGS. 3A through 3C, the widths d1 of the end parts of the cross-sections of the field concentration units 620*a*, 620*b*, and 620*c* are greater than the widths d2 of the central parts of the cross-sections of the field concentration units 620*a*, 620*b*, and 620*c*.

Figure 4A:
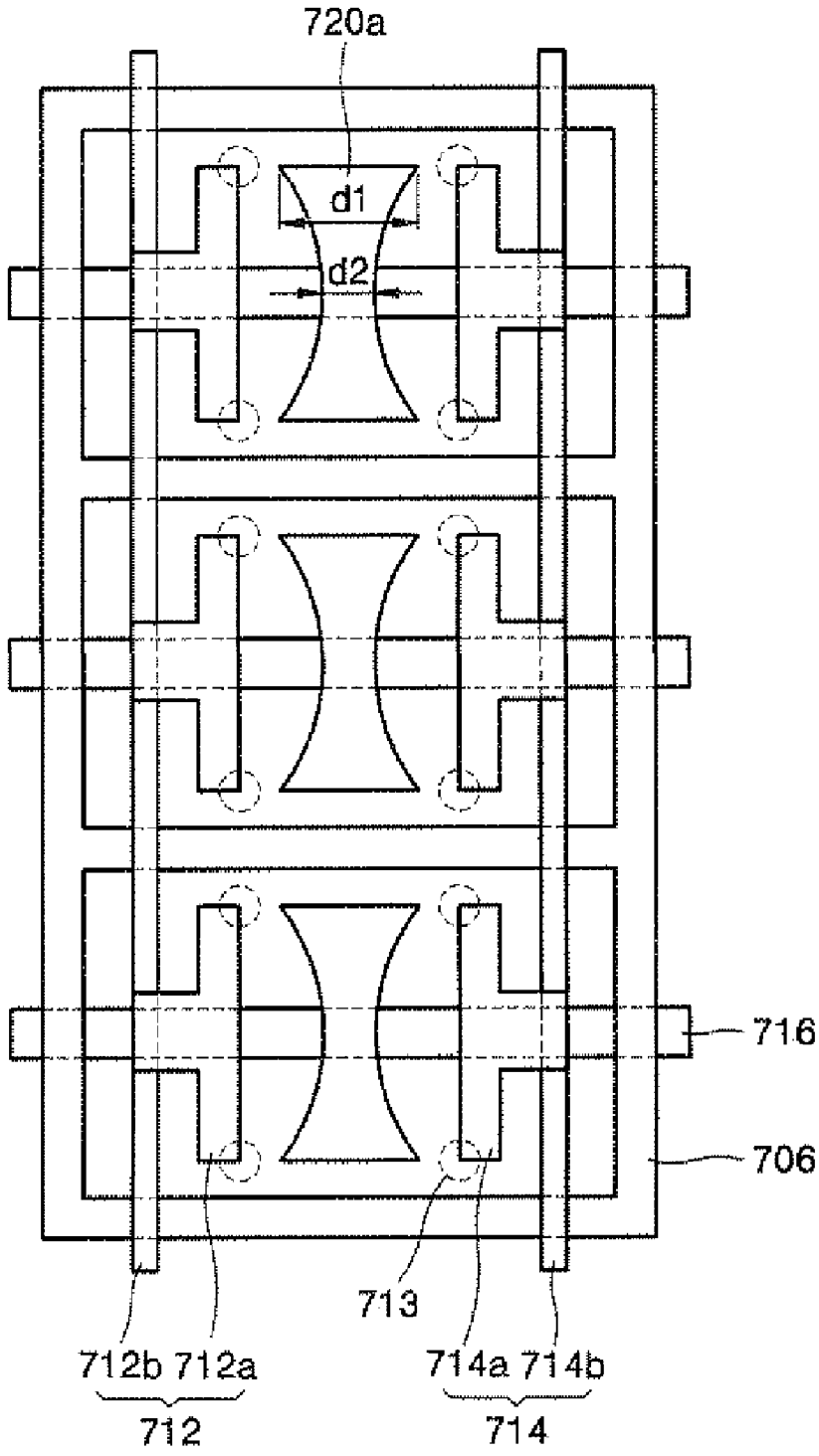
FIG. 4A, FIG. 4B, and FIG. 4C are schematic drawings of discharge cells including field concentration units of plasma display panels according to other exemplary embodiments of the present invention.
Figure 4B:
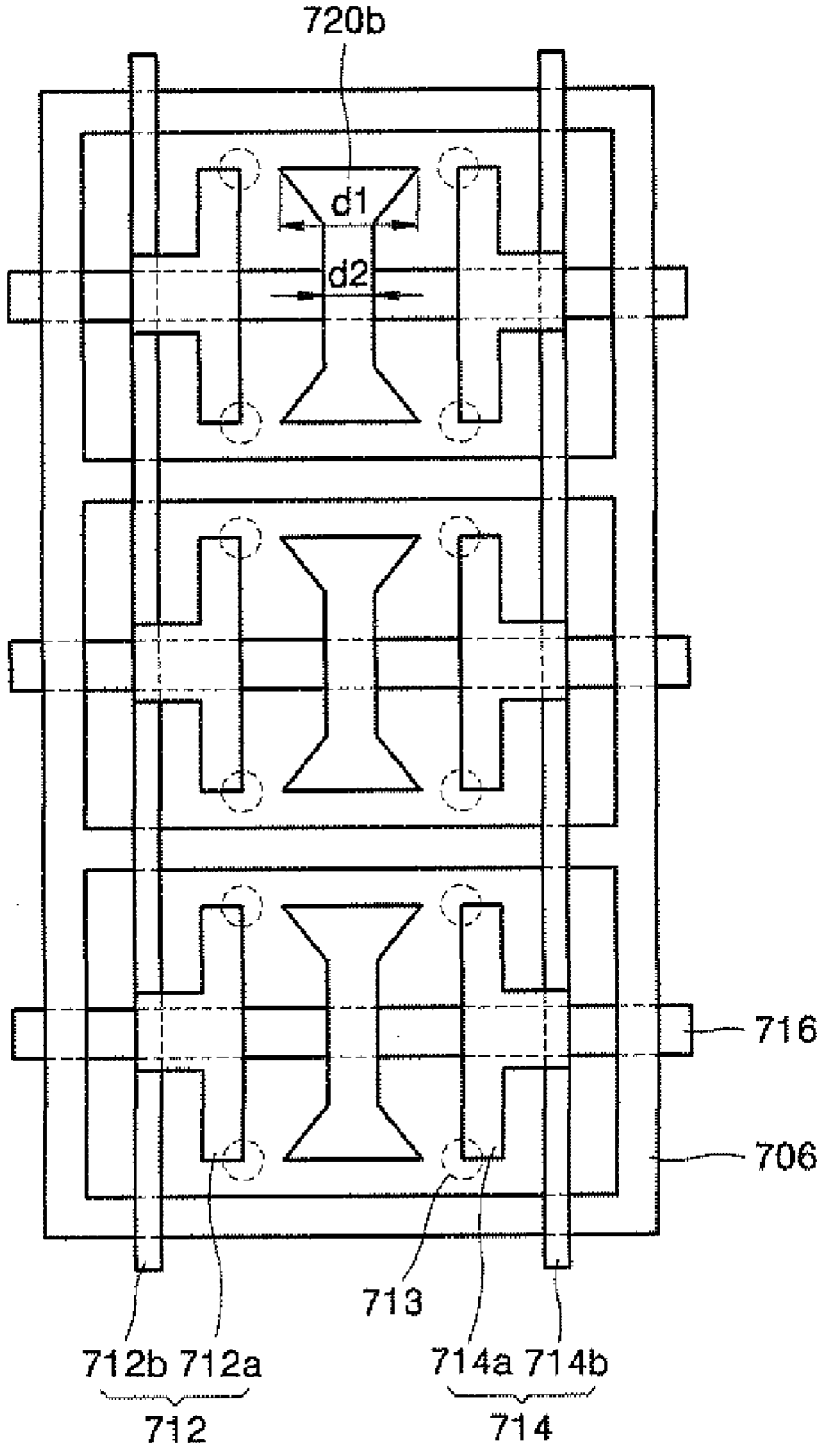
Figure 4C:
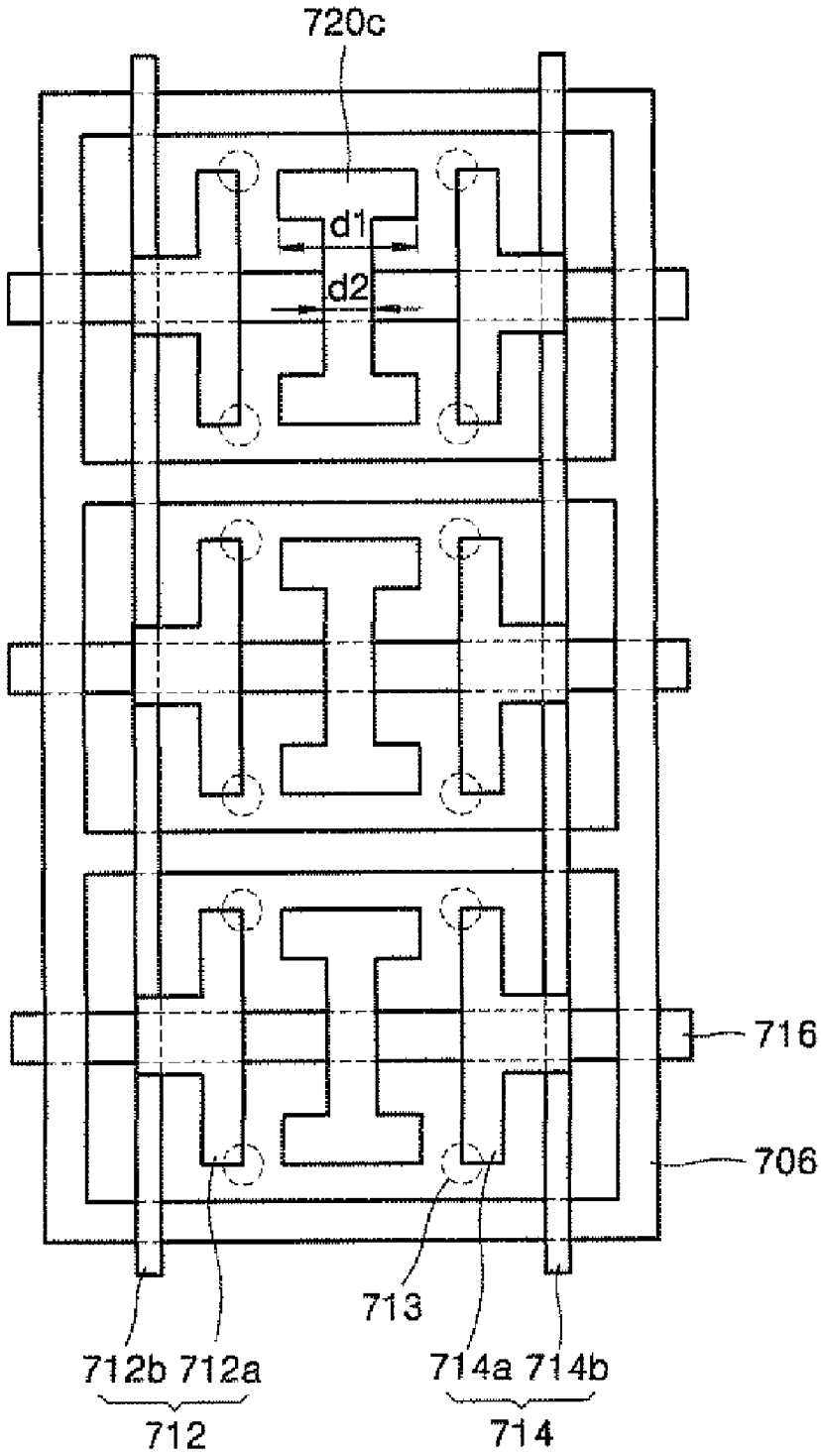

FIG. 4A, FIG. 4B, and FIG. 4C are schematic drawings of discharge cells including field concentration units of plasma display panels according to other exemplary embodiments of the present invention.

Referring to FIG. 4A, FIG. 4B, and FIG. 4C, the transparent electrodes 712*a* and 714*a* have different structures than the transparent electrodes 612*a* and 614*a* of FIG. 3A, FIG. 3B, and FIG. 3C. Similar reference numerals in FIGS. 4A through 4C are used for like elements performing the same functions as those in FIGS. 3A through 3C, and the detailed descriptions thereof will not be repeated, except for the structure of the transparent electrodes 712*a* and 714*a*, which will be described below.

The transparent electrodes 712*a* and 714*a* have a divided structure as shown in FIG. 4A, FIG. 4B, and FIG. 4C, and a horizontal cross-section of the transparent electrodes 712*a* and 714*a* as viewed from the first substrate 102 (see FIG. 1) is T-shaped. In this case, the transparent electrodes 712*a* and 714*a* are smaller than the transparent electrodes 612*a* and 614*a* of FIG. 3A, FIG. 3B, and FIG. 3C. Accordingly, in a plasma display panel that includes the transparent electrodes 712*a* and 714*a* according to the present embodiment, transmittance of visible light may be increased since the transparent electrodes 712*a* and 714*a* occupy less area.

The field concentration units 720*a*, 720*b*, and 720*c* may have various plane shapes as shown in FIG. 4A, FIG. 4B, and FIG. 4C. In FIG. 4A, the width of the cross-section of the field concentration unit 720*a* decreases from its ends to its center in parabolic form. That is, the width of the cross-section of the field concentration unit 720*a* gradually decreases from d1 to d2 to substantially form a parabola.

In FIG. 4B, the width of the cross-section of the field concentration unit 720*b* gradually decreases at a fixed rate from d1 at the ends to d2 at a certain point, and the width d2 is constant in the central part. That is, the width of the cross-section decreases from d1 to d2 at the end parts, and the width d2 of the central part is constant.

In FIG. 4C, the width d1 of end parts of the cross-section of the field concentration unit 720*c* is constant, and the width d2 of the central part is constant. In all cases shown in FIGS. 4A through 4C, the widths d1 of the end parts of the cross-sections of the field concentration units 720*a*, 720*b*, and 720*c* are greater than the widths d2 of the central parts of the cross-sections of the field concentration units 720*a*, 720*b*, and 720*c*.

Figure 6A:
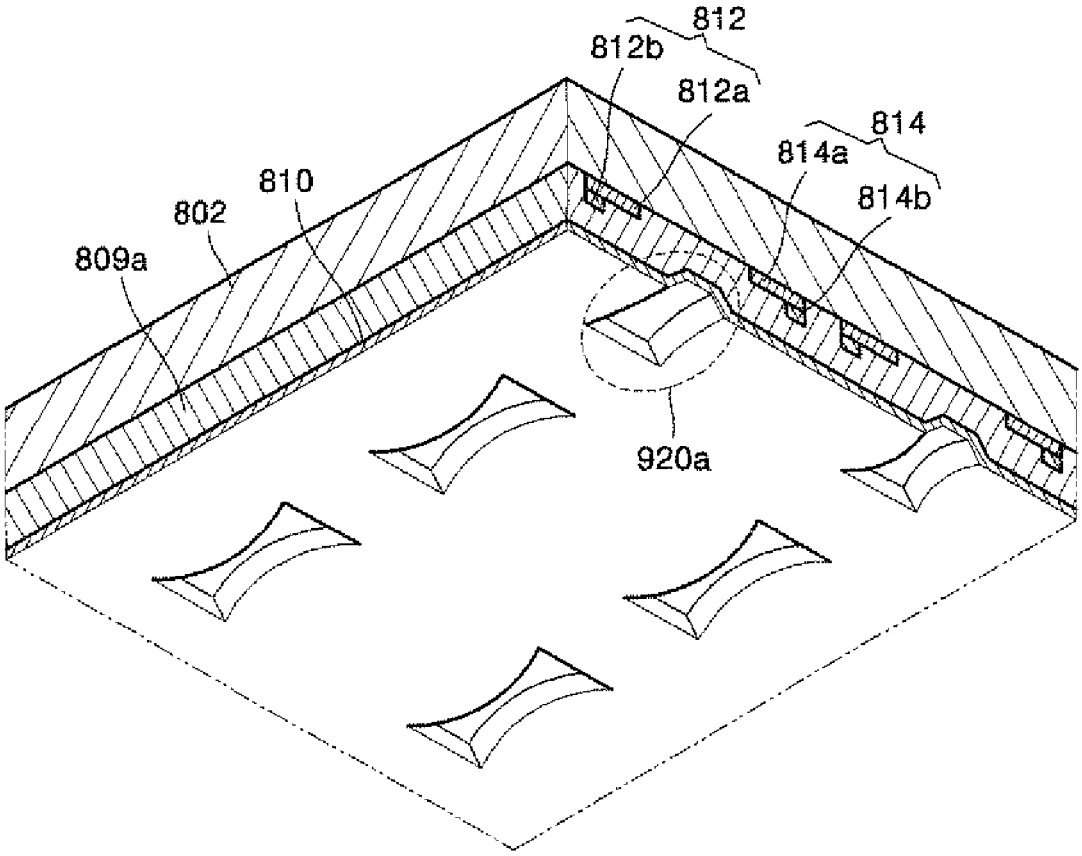
FIG. 6A, FIG. 6B, and FIG. 6C are partial perspective views of first panels on which field concentration units are formed according to exemplary embodiments of the present invention.
Figure 6B:
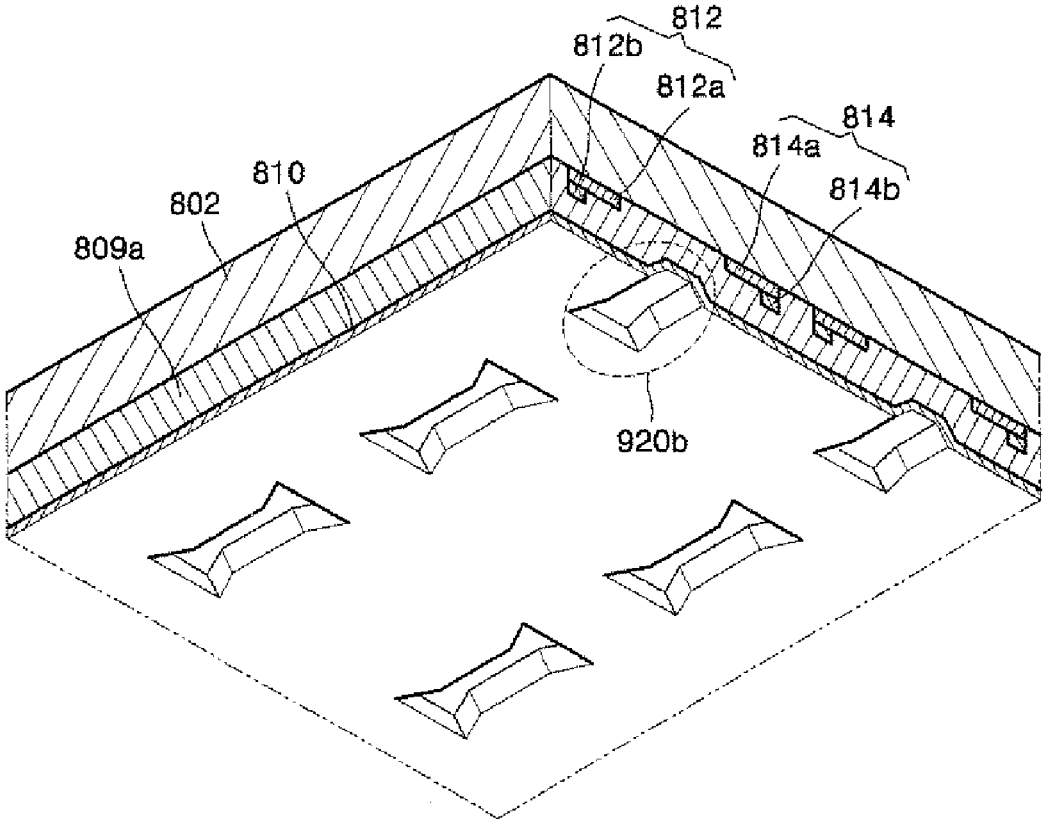
Figure 6C:
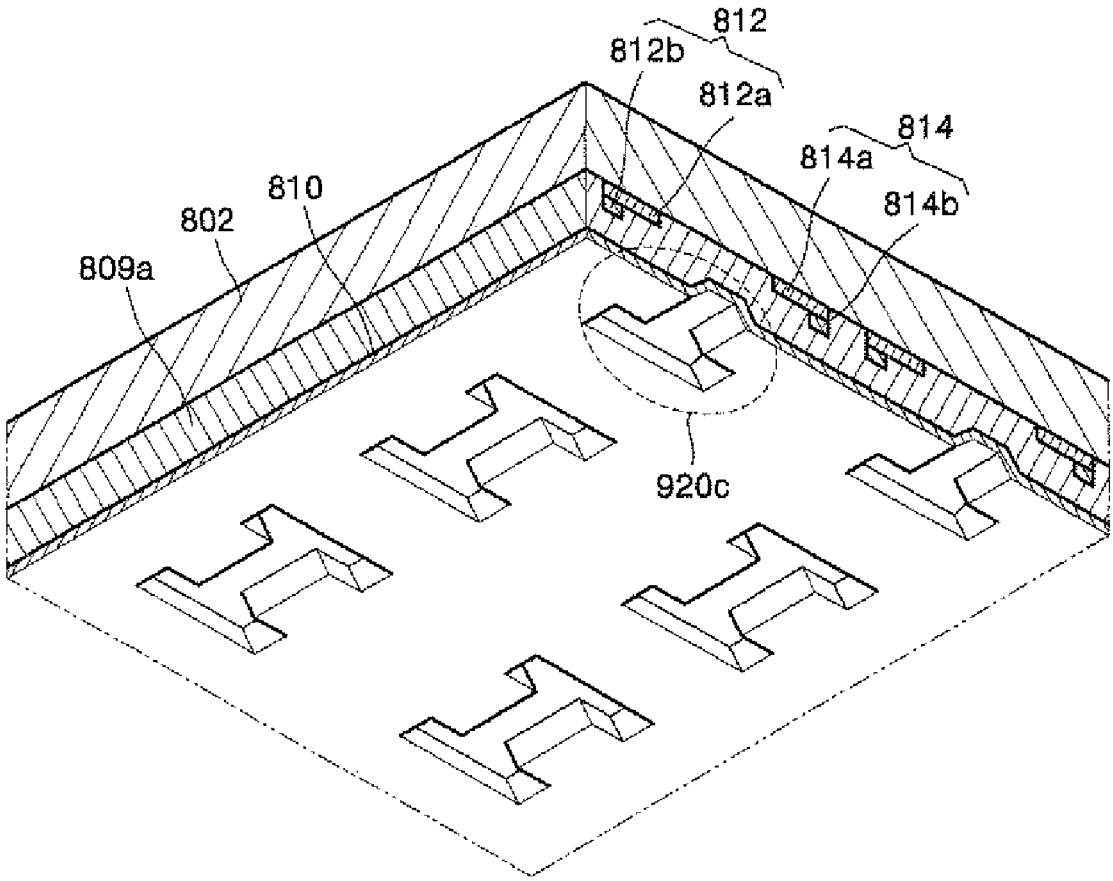

FIG. 5 is a cross-sectional view of a field concentration unit 820 of a plasma display panel according to another exemplary embodiment of the present invention. FIG. 6A, FIG. 6B, and FIG. 6C are perspective views of first panels of the plasma display panel of FIG. 5. Field concentration units 920*a*, 920*b*, and 920*c* of FIG. 6A, FIG. 613, and FIG. 6C have similar patterns to the field concentration units 620*a*, 620*b* and 620*c* of FIG. 3A, FIG. 3B, and FIG. 3C, respectively.

Referring to FIGS. 5 through 6C, cross-sections of the field concentration units 920*a*, 920*b*, and 920*c* perpendicular to a first substrate 802 and parallel to A electrodes 816 may be trapezoidal. Accordingly, the field concentration caused by corner parts of protruded electrodes may be mitigated, and the transmittance of visible light through the first substrate 802 may be increased, thereby increasing the brightness of a displayed image.

Similar reference numerals in FIG. 6A, FIG. 6B, and FIG. 6C are used for like elements performing the same functions as those in FIG. 3A, FIG. 3B, and FIG. 3C. Hence, detailed descriptions thereof will not be repeated, except for the structure of the field concentration units 920*a*, 920*b*, and 920*c*, which will be described below.

The field concentration units 920*a*, 920*b*, and 920*c* of FIG. 6A, FIG. 6B, and FIG. 6C, respectively, are separated from each other. That is, a plurality of the field concentration units 920*a*, 920*b*, and 920*c* (six field concentration units in each of FIG. 6A, FIG. 6B, and FIG. 6C) are formed in the corresponding discharge cells (six discharge cells in each of FIG. 6A, FIG. 6B, and FIG. 6C) in the first dielectric layer 809*a*. The field concentration units 920*a*, 920*b*, and 920*c* may be separated by portions of the first dielectric layer 809*a* corresponding to the barrier ribs 806.

A plasma display panel according to exemplary embodiments of the present invention may display an image with improved quality through a stable discharge achieved by forming a substantially uniform field around electrodes having a protruding structure.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:
a first substrate;
a second substrate that faces the first substrate;
barrier ribs that define a plurality of discharge cells in a space between the first substrate and the second substrate;
common electrodes and scanning electrodes arranged on the first substrate and comprising a protruded structure in the discharge cells;
a first dielectric layer that covers the common electrodes and the scanning electrodes, the first dielectric layer comprising groove shaped field concentration units;
address electrodes arranged on the second substrate and extending substantially perpendicular to the common electrodes;
a second dielectric layer covering the address electrodes;
a phosphor layer arranged in the discharge cells; and
a discharge gas in the discharge cells,
wherein end parts of the field concentration units are wider than the central part of the field concentration units.

2. The plasma display panel of claim 1, wherein the field concentration units are respectively formed in the discharge cells, and portions of the first dielectric layer corresponding to the barrier ribs separate the field concentration units.

3. The plasma display panel of claim 1, wherein the width of the field concentration units gradually decreases from the end parts of the field concentration units toward the central part of the field concentration units to form a parabolic shape.

4. The plasma display panel of claim 1, wherein the width of the field concentration units linearly decreases from the end parts of the field concentration units toward the central part of the field concentration units, and the width of the central part of the field concentration units is constant.

5. The plasma display panel of claim 1, wherein the width of the end parts of the field concentration units is constant, and the width of the central part of the field concentration units is constant.

6. The plasma display panel of claim 1, wherein both the common electrodes and the scanning electrodes comprise:
a bus electrode comprising one body structure extending in a first direction; and
a transparent electrode comprising a segmented structure such that segments of the transparent electrode corresponding to the discharge cells are separated from each other by portions of the bus electrode corresponding to the barrier ribs.

7. The plasma display panel of claim 6, wherein the segments of the transparent electrode form the protruded structure of the common electrodes and the scanning electrodes.

8. The plasma display panel of claim 7, wherein the segments of the transparent electrode are rectangular.

9. The plasma display panel of claim 7, wherein the segments of the transparent electrode are T-shaped.

10. The plasma display panel of claim 1, wherein a cross-section of the field concentration units cut perpendicular to the first substrate and parallel to the address electrodes is substantially rectangular.

11. The plasma display panel of claim 1, wherein a cross-section of the field concentration units cut perpendicular to the first substrate and parallel to the address electrodes is substantially trapezoidal.

12. The plasma display panel of claim 1, further comprising a protection film protecting the first dielectric layer.

13. The plasma display panel of claim 1, wherein the phosphor layer is arranged on the barrier ribs and the second dielectric layer.

14. A plasma display panel, comprising:

a first substrate;

a second substrate that faces the first substrate;

barrier ribs that define a plurality of discharge cells in a space between the first substrate and the second substrate;

first electrodes and second electrodes arranged on the first substrate; and a dielectric layer that covers the first electrodes and the second electrodes, the dielectric layer comprising groove shaped field concentration units arranged between the first electrodes and the second electrodes, wherein ends of the field concentration units are wider than the central part of the field concentration units.

15. The plasma display panel of claim 14, wherein both the first electrodes and the second electrodes comprise a protruded structure in each discharge cell.

16. The plasma display panel of claim 15, wherein the field concentration units are respectively formed in the discharge cells, and portions of the dielectric layer corresponding to the barrier ribs separate the field concentration units.

17. The plasma display panel of claim 15, wherein the width of the field concentration units gradually decreases from the ends of the field concentration units toward the central part of the field concentration units to form a parabolic shape.

18. The plasma display panel of claim 15, wherein the width of the field concentration units linearly decreases from the end parts of the field concentration units toward the central part of the field concentration units, and the width of the central part of the field concentration units is constant.

19. The plasma display panel of claim 15, wherein the width of the end parts of the field concentration units is constant, and the width of the central part of the field concentration units is constant.

20. The plasma display panel of claim 15, wherein both the first electrodes and the second electrodes comprise:

a bus electrode comprising one body structure extending in a first direction; and a transparent electrode comprising a segmented structure such that segments of the transparent electrode corresponding to the discharge cells are separated from each other by portions of the bus electrode corresponding to the barrier ribs.

* * * * *